United States Patent [19]

Stalder et al.

[11] Patent Number: 4,520,532

[45] Date of Patent: Jun. 4, 1985

[54] DRAFTING MECHANISM FOR SPINNING MACHINES

[75] Inventors: Herbert Stalder; Emil Briner, both of Winterthur, Switzerland

[73] Assignee: Rieter Machine Works Limited, Winterthur, Switzerland

[21] Appl. No.: 536,653

[22] Filed: Sep. 28, 1983

[30] Foreign Application Priority Data

Oct. 11, 1982 [CH] Switzerland ..... 5945/82

[51] Int. Cl.[3] ..... D01H 1/22

[52] U.S. Cl. ..... 19/244; 19/255

[58] Field of Search ..... 11/244, 255

[56] References Cited

U.S. PATENT DOCUMENTS

| | | | |
|---|---|---|---|
| 2,896,269 | 7/1959 | Gardella | 19/244 X |
| 2,994,086 | 7/1961 | Quaas | 19/255 |
| 3,001,241 | 9/1961 | Aymerich | 19/244 |
| 3,125,784 | 3/1964 | Macdonald | 19/255 |
| 3,126,585 | 3/1964 | Tabor et al. | 19/244 |
| 4,398,320 | 8/1983 | Kubota et al. | 19/244 X |

FOREIGN PATENT DOCUMENTS

| | | | |
|---|---|---|---|
| 718112 | 2/1942 | Fed. Rep. of Germany | 19/255 |
| 3039149 | 5/1981 | Fed. Rep. of Germany . | |
| 1135331 | 4/1957 | France | 19/244 |
| 503789 | 12/1954 | Italy | 19/244 |
| 737452 | 9/1955 | United Kingdom | 19/255 |
| 1378177 | 12/1974 | United Kingdom | 19/244 |

*Primary Examiner*—Louis K. Rimrodt

*Attorney, Agent, or Firm*—Werner W. Kleeman

[57] ABSTRACT

The drafting mechanism comprises an entry roller pair, an intermediate roller pair and a delivery roller pair. An apron hair is mounted such that one of the two aprons projects deeper than the other into the converging space of the pair of delivery rollers, so that the fiber sliver is still diverted, and is thus guided, after the exit or delivery opening of the aprons, on the apron projecting more deeply into the converging space. Further, both aprons are guided sufficiently close to their related delivery roller such that the aprons do not contact these rollers but leave open a minimal air gap, so that only a minimal quantity of the circulating air produced by the rotating delivery rollers can penetrate into the converging space.

5 Claims, 4 Drawing Figures

DRAFTING MECHANISM FOR SPINNING MACHINES

BACKGROUND OF THE INVENTION

The present invention relates to a new and improved drafting mechanism for spinning machines, in particular for air jet spinning machines.

In its more particular aspects, the drafting mechanism of the invention is of the type comprising at least one delivery roller pair together with a further roller pair located upstream from the delivery roller pair considered in the direction of movement of the fiber sliver or the like, the rollers of the further roller pair being provided with respective aprons for guiding the fiber sliver, the exit opening of the apron pair being so arranged in relation to the nip line of the delivery roller pair that the fiber sliver undergoes at least one diversion or deflection in the region between the exit opening and the nip line.

In the course of drafting short staple fiber sliver to yarn or the like , with increasing fineness of the yarns there is increasingly present the necessity to guide the fibers as far as possible between the nip points of a drafting passage.

This requirement is especially important in so-called jet spinning processes, in which drawing frame sliver is drawn by a drafting mechanism having only three or two drafting zones into feed material ready for formation of yarn by the jet spinning process.

In addition, in the jet spinning method, the air flows prevailing at the circumference of the delivery rollers of the drafting mechanism, caused by the high peripheral speeds of approximately 150 m/min., can cause edge fibers to be separated or spread out from the body of fibers shortly before being grasped by the nip of the delivery roller pair. This phenomenon results either in loss of fibers or irregularity in the yarn. The separation or spreading of the fibers occurs in the converging space or region of the delivery roller pair, that is in the region of the entry zone to the nip of the two delivery rollers. In this zone, the peripherally directed air flows or air streams of the rotating rollers are diverted to air flows or air streams directed substantially parallel to the axes of the rollers, which causes the aforementioned undesirable separation and/or spreading of the edge fibers. Since the separation and spreading of the fibers as a result of these airstreams is highly variable, this results in the already mentioned irregularity in the yarn.

In order to avoid this, it is proposed in German Published Patent Specification No. 3,039,149, to displace the exit opening of the apron drafting mechanism relative to the nip location of the delivery rollers in a direction normal to the "path of the fiber flow" (see claim 2 and FIG. 2 of the just mentioned German Patent Specification). Through this displacement, the fiber path is supposed to evade the transverse air flows, that is to say, this fiber path to a certain extent is to bypass such transverse air flows, in order to reach the nip in the region close to the surface of the adjacent roller.

The disadvantage of this system is that the peripherally directed air flow of the adjacent roller flows through the fiber sliver from one side thereof and thus causes transverse bending and from which bent fiber sliver fiber ends are spread-out in the transverse flow zone, so that the disadvantage which was to be eliminated is reproduced in another manner.

SUMMARY OF THE INVENTION

Therefore, with the foregoing in mind it is a primary object of the present invention to provide a new and improved construction of drafting mechanism for spinning machines which is not afflicted with the aforementioned drawbacks and limitations of the prior art proposals.

Another more specific object of the present invention is to substantially avoid loss and/or spreading-out of fibers by the action of air streams.

Now in order to implement these and still further objects of the invention, which will become more readily apparent as the description proceeds, the drafting mechanism of the present development is manifested by the features that, one of the two aprons projects into the converging space or region of the delivery roller pair, the fiber sliver is deflected or diverted about that apron which projects into the converging space of the delivery roller pair, and both aprons are guided close to the delivery rollers such that, on the one hand, the aprons do not contact the delivery rollers and, on the other hand, the air gap between the aprons and the delivery rollers is as small as possible.

Either the lower or the upper apron can project into the converging space.

The advantages of the invention are to be seen in that, on the one hand, the unguided length of fiber sliver is shorter than in drafting mechanisms in which neither of the two aprons projects into the converging space or region and, on the other hand, the circumferential air streams of the rotating rollers are practically excluded from the converging space, so that the irregular fiber spreading and separation of edge fibers is substantially prevented, and thus, the regularity of the yarn is improved.

In a further advantageous embodiment, the upper delivery roller can be arranged displaced in a direction towards the upper apron.

The advantage of this embodiment is that the reduction of the diameter of the upper delivery roller, which is normal after a certain operating time, can be carried out practically without increasing the size of the air gap.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 2:
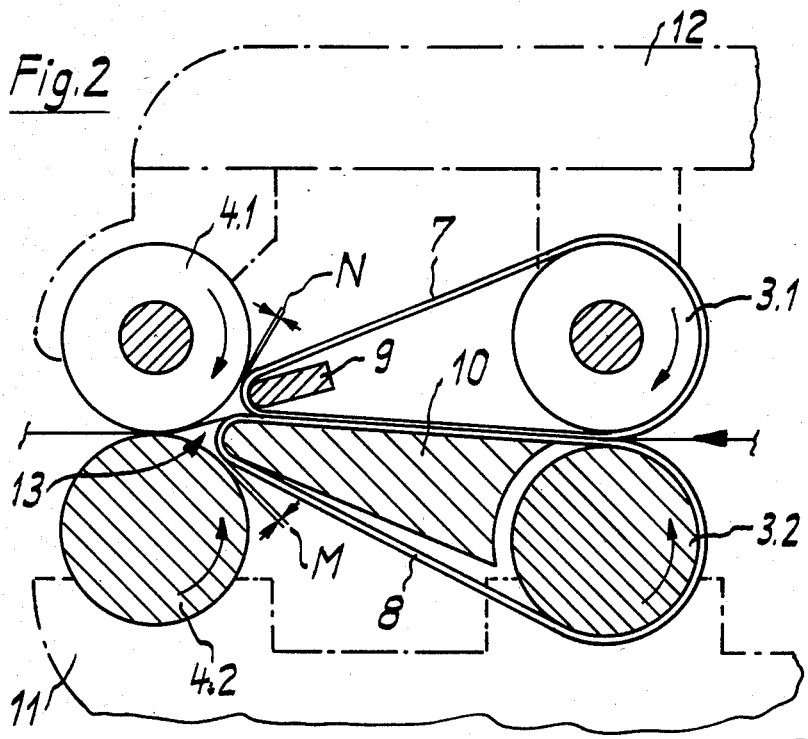
FIG. 2 shows a detail of the drafting mechanism of FIG. 1, on an enlarged scale and showing only one drafting zone.

Describing now the drawings, it is to be understood that only enough of the construction of the drafting mechanism for spinning machines has been shown as needed for those skilled in the art to readily understand the underlying principles and concepts of the present development, while simplifying the illustration of the drawings. Turning attention now to the first exemplary embodiment depicted in FIGS. 1 and 2 there is depicted therein a two-zone drafting mechanism 1 of a spinning machine, for example a jet spinning machine, which comprises an entry or infeed roller pair 2 with an upper entry or infeed roller 2.1 and a lower entry or infeed roller 2.2, an intermediate roller pair 3 with an upper intermediate roller 3.1 and a lower intermediate roller 3.2, and a delivery roller pair 4, with an upper delivery roller 4.1 and a lower delivery roller 4.2. The drafting zone between the entry or infeed roller pair 2 and the intermediate roller pair 3 is designated a preliminary drafting zone and that between the intermediate roller pair 3 and the delivery roller pair 4 is designated a main drafting zone.

Figure 1:
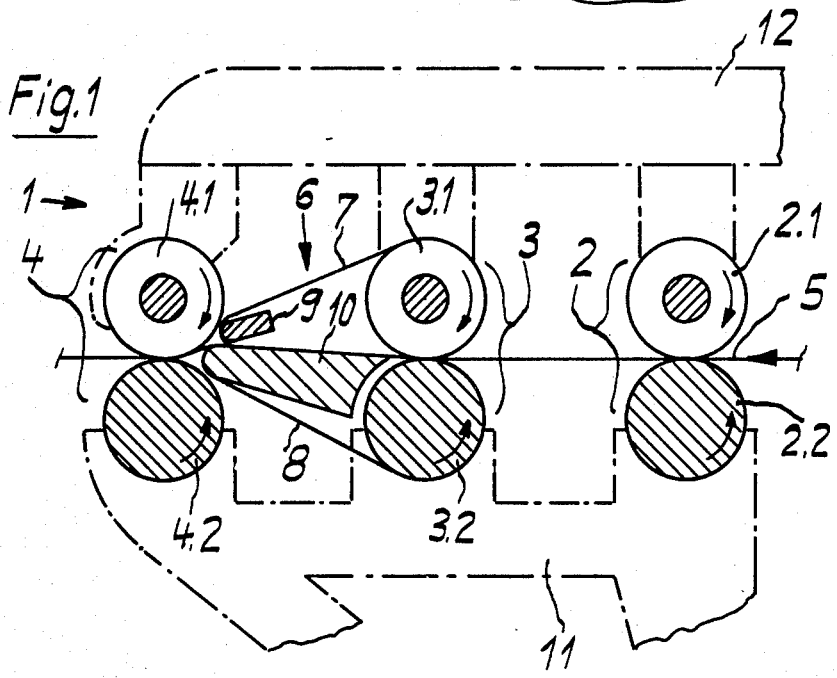
FIG. 1 shows a cross-section through a two-zone apron drafting mechanism, represented part-schematically.

In the main drafting zone, a fiber sliver 5, which is to be drafted and which is moving in the direction of the indicated arrow at the right-hand side of FIGS. 1 and 2, is guided by an apron pair 6 comprising an upper apron 7 and a lower apron 8.

The upper apron 8 is driven by the upper intermediate roller 3.1, and is diverted or turned at the exit end by a bar or web 9, while the lower apron 8 is driven by the lower intermediate roller 3.2 and is diverted or turned at the exit end by a plate 10. The two diversion or turning locations of the aprons 7 and 8, defined respectively by the bar 9 and plate 10, form the exit or delivery opening of the apron pair 6.

The lower rollers 2.2, 3.2 and 4.2 and the plate 10 are stationarily mounted on a support 11 (indicated with dotted lines), and the upper rollers 2.1, 3.1 and 4.1, and the bar 9 are pivotably mounted by means of a bracket or yoke 12 (indicated with dotted lines) which is pivotable about a pivot point (not shown), so as to be liftable away from the lower situated elements 2.2, 3.2, 4.2 and 11.

The upper rollers 2.1, 3.2 and 4.1, and the bar 9 are resiliently mounted in a known manner in the bracket or yoke 12, so that the upper rollers 2.1, 3.1 and 4.1 and also the upper apron 7 are pressed with a bias against the lower rollers 2.2, 3.2 and 4.2 and the lower apron 8, respectively.

The lower apron 8 projects at its diversion or turning location defined by the plate 10 beyond the upper apron 7 into the converging space or region 13 (FIG. 2) of the delivery roller pair 4 such that, on the one hand, the fiber sliver 5 undergoes a diversion or deflection at the diverting or turning location of the lower apron 8, and, on the other hand, the spacing M between the lower apron 8 and the lower delivery roller 4.2 is as small as possible but such that no contact can occur between this lower apron 8 and the delivery roller 4.2. In this manner, on the one hand, the unguided length of the fiber sliver 5 is maintained as short as possible and, on the other hand, penetration of circumferential air from the delivery roller 4.2, rotating in the direction of the indicated arrow, into the converging space or region 13 is reduced to a minimum, that means practically prevented.

The upper apron 8, in turn, also arranged close to the upper delivery roller 4.1 such that the spacing N substantially corresponds to the spacing M in order to perform the same function as previously described for the spacing M.

Figure 3:
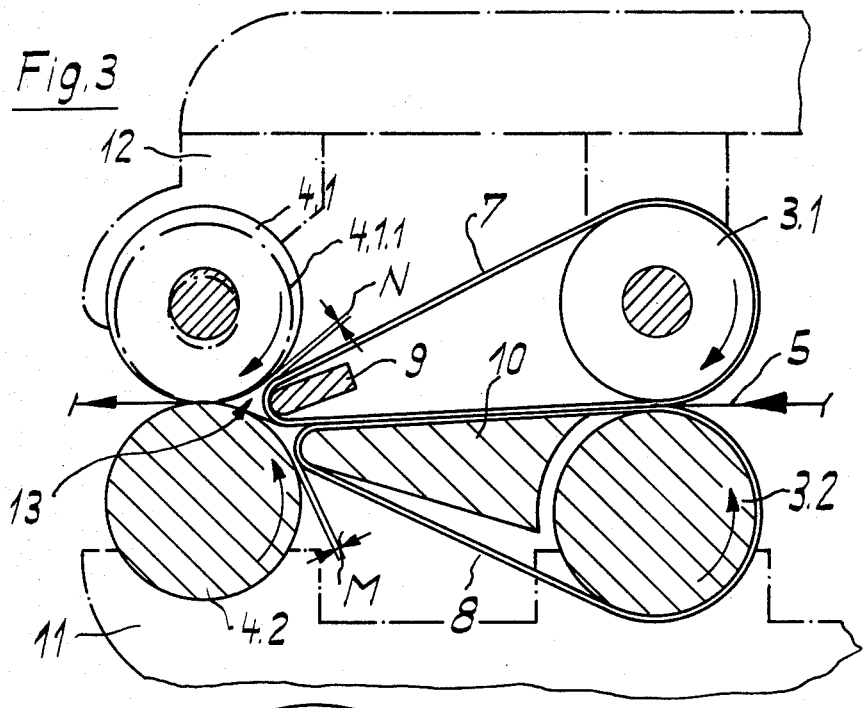
FIG. 3 shows a modification of the drafting zone of FIG. 2 on the same scale and part-schematically illustrated.

As a modification as shown in FIG. 3 instead of the heretofore described greater extent of the lower apron 8, the upper apron 7 can be made to extend further than the lower apron 8 into the converging space or region 13 in order to fulfill the same purpose. The spacings or distances M and N are likewise maintained in the manner previously described.

It is further mentioned that in such drafting mechanisms the upper rollers 2.1, 3.1 and 4.1 are generally made of hard rubber and during operation wear in such manner that at least once during their operating life they are reduced to a smaller diameter, in order to thereby once again obtain an as-new surface. Through this reduction to a roller diameter in accordance with the roller 4.1.1 (indicated in FIGS. 3 and 4 with dotted lines) there occurs in the embodiment according to FIG. 3 an increase in the size of the air gap or space N, so that as a result an undesired increased amount of circumferential air can flow into the converging space 13. This increase in the size of the air gap N in the modification according to FIG. 3 is somewhat less than in the arrangement according to FIGS. 1 and 2, since in the arrangement according to FIG. 3 the upper apron 7 projects further into the converging space 13, and thus, the diameter difference has a lesser effect.

Figure 4:
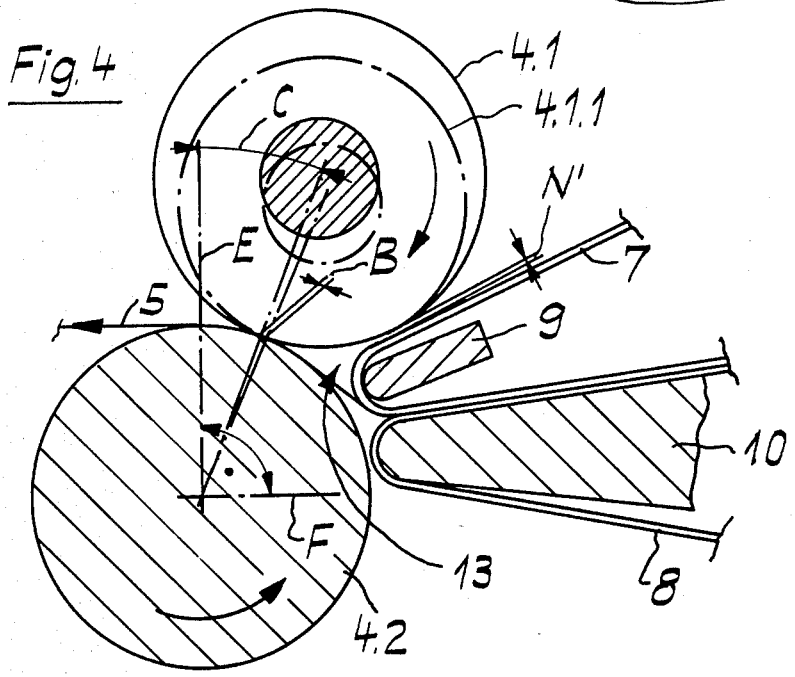
FIG. 4 shows a modification of a part of the drafting zone of FIG. 3, enlarged relative to FIG. 3 and illustrated part-schematically.

In order to practically avoid this widening of the air gap or space N, the upper delivery roller 4.1 is advantageously shifted or displaced towards the upper apron 7 as shown in FIG. 4. By virtue of this measure, the line of contact of the upper and lower delivery rollers 4.1, 4.2 is lower, after carrying out the diameter reduction, by an amount corresponding to an arc length B circumscribed on the circumference of the lower delivery roller 4.2, that is, is displaced further towards the upper apron 7 relative to the position such upper delivery roller 4.1 assumes without diameter reduction. Through this displacement, a substantial part of the air gap widening is compensated, that is the air gap N′ corresponds substantially to the air gap N. The optimal arc length, through which the upper delivery roller 4.1 is to be displaced towards the upper apron 7, depends upon the type of apron and its arrangement.

In an arrangement as illustrated in FIG. 4, the arc length C (FIG. 4) through which the upper delivery roll 4.1.1 is shifted corresponds substantially to one-third of the diameter of the upper delivery roller 4.1 prior to any diameter reduction thereof. The arc length C extends from an imaginary plane E which passes through the rotational axis of the lower delivery roller 4.2 and extends perpendicular to an imaginary plane F in which lies the rotational axes of the lower delivery roller 4.2 and the lower intermediate roller 3.2.

While there are shown and described present preferred embodiments of the invention, it is to be distinctly understood that the invention is not limited thereto, but may be otherwise variously embodied and practiced within the scope of the following claims. Accordingly,

What we claim is:

1. A drafting mechanism for spinning machines for drafting fiber slivers, in particular for jet spinning machines comprising:

a pair of rollers;

a respective apron provided for each of the rollers of said pair of rollers for guiding a fiber sliver between said aprons;

said aprons defining an apron pair having an exit opening;

at least one pair of delivery rollers arranged downstream of said pair of rollers provided with said aprons, viewed with respect to a predetermined direction of movement of the fiber sliver;

said exit opening of the pair of aprons being arranged in relation to a nip line of the pair of delivery rollers such that the fiber sliver undergoes at least one diversion at a region between said exit opening and said nip line;

said pair of delivery rollers defining a converging space;

one of said two aprons projecting into said converging space of said pair of delivery rollers;

said fiber sliver being diverted about said one of the two aprons which projects into said converging space of the pair of delivery rollers; and both aprons being guided close to the pair of delivery rollers such that said aprons do not contact said pair of delivery rollers and an air gap between the aprons and said pair of delivery rollers essentially is as small as possible in order to divert circumferentially directed air streams which are entrained by the rotating delivery rollers, substantially along said rotating delivery rollers and thereby preventing such air streams from entering said converging space defined by said pair of delivery rollers and acting upon the fiber sliver drawn from said exit opening of said pair of aprons through said converging space defined by said pair of delivery rollers.

2. The drafting mechanism as defined in claim 1, wherein:

said pair of aprons defines an upper apron and a lower apron; and the lower apron projecting further into the converging space than the upper apron.

3. The drafting mechanism as defined in claim 1, wherein:

said pair of aprons defines an upper apron and a lower apron; and the upper apron projecting further into the converging space than the lower apron.

4. The drafting mechanism as defined in claim 3, wherein:

said pair of delivery rollers define an upper delivery roller and a lower delivery roller; and the upper delivery roller being arranged displaced towards the upper apron relative to the lower delivery roller.

5. The drafting mechanism as defined in claim 4, wherein:

each of said delivery rollers having a respective axis of rotation;

said upper delivery roller being displaced such that its axis of rotation is arranged in pivoted relationship with respect to the lower delivery roller through an arcuate path corresponding approximately to one-third of an original diameter of said upper delivery roller prior to machining-reduction of its diameter;

said pair of rollers provided with said aprons defining an upper intermediate roller and a lower intermediate roller;

each of said intermediate rollers having a respective axis of rotation;

said arcuate path extending from an imaginary plane passing through the axis of rotation of the lower delivery roller; and said imaginary plane extending substantially perpendicular to an imaginary plane containing the axis of rotation of the lower delivery roller and the lower intermediate roller.

* * * * *

UNITED STATES PATENT AND TRADEMARK OFFICE

CERTIFICATE OF CORRECTION

PATENT NO. : 4,520,532

DATED : June 4, 1985

INVENTOR(S) : Herbert Stalder et al

It is certified that error appears in the above—identified patent and that said Letters Patent is hereby corrected as shown below:

In the abstract, line 3, please delete "hair" and insert --pair--

Signed and Sealed this

*Fifteenth* Day of *October 1985*

[SEAL]

*Attest:*

DONALD J. QUIGG

*Attesting Officer*

*Commissioner of Patents and Trademarks—Designate*